US011603816B2

(12) United States Patent
Klosterberg et al.

(10) Patent No.: US 11,603,816 B2
(45) Date of Patent: Mar. 14, 2023

(54) INJECTOR CLAMPING MECHANISM

(71) Applicant: DEUTZ Aktiengesellschaft, Cologne (DE)

(72) Inventors: Johannes Klosterberg, Swisttal (DE); Thomas Werner, Cologne (DE); Alfred Inden, Pulheim (DE)

(73) Assignee: Deutz Aktiengesellschaft, Cologne (DE)

( * ) Notice: Subject to any disclaimer, the term of this patent is extended or adjusted under 35 U.S.C. 154(b) by 21 days.

(21) Appl. No.: 17/378,800

(22) Filed: Jul. 19, 2021

(65) Prior Publication Data

US 2022/0034286 A1 Feb. 3, 2022

(30) Foreign Application Priority Data

Jul. 30, 2020 (DE) ..... 10 2020 004 625.8

(51) Int. Cl.
*F02M 61/14* (2006.01)

(52) U.S. Cl.
CPC ..... *F02M 61/14* (2013.01); *F02M 2200/852* (2013.01); *F02M 2200/855* (2013.01); *F02M 2200/858* (2013.01)

(58) Field of Classification Search
CPC ..... F02M 61/14; F02M 2200/803; F02M 2200/855
See application file for complete search history.

(56) References Cited

U.S. PATENT DOCUMENTS 3,924,583 A * 12/1975 Jardin ..... F02M 55/00 123/470
4,203,402 A * 5/1980 Freyn ..... F02M 61/14 123/470

(Continued)

FOREIGN PATENT DOCUMENTS

DE 195 21363 C1 9/1996
DE 102007050512 A1 4/2009

(Continued)

OTHER PUBLICATIONS

English machine translation of Description for JP-11101170-A provided by ESPACENET (Year: 2021).*

*Primary Examiner* — Michael A Kessler
(74) *Attorney, Agent, or Firm* — Davidson, Davidson & Kappel, LLC

(57) ABSTRACT

An internal combustion engine, in particular a diesel engine, in particular of a motor vehicle, includes at least one working cylinder and one cylinder head closing the working cylinder, in which an injector for injecting fuel is situated for the working cylinder. The engine includes a clamping claw for the injector for injecting fuel, whose one end is supported on the other end, in which at least two arms are provided in such a way that one arm of the clamping claw acts upon an injector in each case, and the injector presses against a seat or a seal in the cylinder head in a sealing manner with the aid of a defined force. The engine also include a clamping screw designed as a push-through screw and including a screw head collar and a corresponding thread is provided in the cylinder head, which fastens the clamping claw at the cylinder head. The arms of the clamping claw are designed in such a way that the arms of the clamping claw are supported on a support surface at the injector and on a support surface at the cylinder head.

14 Claims, 2 Drawing Sheets

(56) References Cited

U.S. PATENT DOCUMENTS

| | | | | |
|---|---|---|---|---|
| 4,246,877 | A * | 1/1981 | Kennedy | F02M 61/14 123/470 |
| 6,170,467 | B1 | 1/2001 | Girard | |
| 6,196,194 | B1 * | 3/2001 | Mitchell | F02M 61/14 123/470 |
| 6,431,152 | B1 * | 8/2002 | Estacio | F02M 61/14 123/470 |
| 6,745,752 | B1 * | 6/2004 | Jensen | B25B 27/0028 123/470 |
| 7,334,572 | B1 | 2/2008 | Digs et al. | |
| 2004/0159311 | A1 * | 8/2004 | Anello | F02M 61/14 123/470 |
| 2013/0174810 | A1 * | 7/2013 | Levey | F02M 69/04 123/470 |

FOREIGN PATENT DOCUMENTS

| | | | | | |
|---|---|---|---|---|---|
| DE | 10340911 | B4 | | 12/2014 | |
| DE | 102017221334 | A1 | * | 5/2019 | F02M 61/14 |
| EP | 0 751290 | B1 | | 3/2000 | |
| EP | 1887215 | A1 | | 2/2008 | |
| EP | 2113654 | B1 | | 5/2014 | |
| FR | 2864170 | A1 | * | 6/2005 | F02M 61/14 |
| GB | 1346501 | A | * | 2/1974 | |
| GB | 2302136 | B | | 5/1997 | |
| JP | H10252609 | A | * | 9/1998 | |
| JP | 11101170 | A | * | 4/1999 | F02M 61/14 |
| JP | 2001041131 | A | * | 2/2001 | |

* cited by examiner

- Prior Art -

INJECTOR CLAMPING MECHANISM

This claims the benefit of German Patent Application DE 10 2020 004 625.8, filed Jul. 30, 2020 which is hereby incorporated by reference herein.

The present disclosure relates to an injector clamping mechanism, including a clamping screw, at an internal combustion engine.

BACKGROUND

Injector clamping mechanisms of this type at an internal combustion engine, are known, for example, from DE 102007050512A1.

EP 2 113 654 B1 further describes a compound assembly for fastening one or multiple injection nozzle holders at a cylinder head of an internal combustion engine.

DE 10340911 B4 also shows an injector clamping mechanism of this type at an internal combustion engine.

A device for fastening an injection nozzle holder at the cylinder head with the aid of a two-armed clamping claw and a clamping screw is known, for example, from DE 195 21 363 C1. During assembly, however, the forked claw arms of the clamping claw must be locally mounted at the injection nozzle holder and the clamping screw at the clamping claw for each injection valve of the internal combustion engine, since they may not be mounted together, due to their structurally predefined shape. This prevents an automatic mounting of the injection nozzle holder at the cylinder head.

Moreover, a system and a method for fastening a fuel injection valve in a combustion engine is known from U.S. Pat. No. 7,334,572 B1, which include a clip for fastening adjacent injection valves at a cylinder head.

An arrangement for clamping two or three fuel injection nozzles using a nozzle clamping unit is known from EP 0 751 290 B1. The nozzle clamping unit includes contact parts, which rest on clamping holder seats of the fuel injection nozzles. The nozzle clamping unit has a bolt insertion hole between the contact parts, into which a clamping bolt is inserted to apply pressure against the fuel injection nozzles and to provide sealing loads. The nozzle clamping unit contains a clearance, which reduces the pressure force on the fuel injection nozzles, so that an essentially identical pressure force on the three fuel injection nozzles occurs upon a predetermined degree of bolt tightening force. Alternatively, the nozzle clamping unit is manufactured from a spring material in such a way that the nozzle clamping unit may be easily bent.

SUMMARY

It is an object of the present disclosure is to avoid the aforementioned disadvantages and to improve an internal combustion engine of the type mentioned above with respect to assembly and maintenance friendliness, which simultaneously increases the elasticity of the bolted joint.

The present disclosure provides an internal combustion engine, in particular a diesel engine, in particular of a motor vehicle, including at least one working cylinder and one cylinder head (4) closing the working cylinder, in which an injector for injecting fuel (3) is situated for the working cylinder, a clamping claw being provided for fixing the injector for injecting fuel being provided in such a way that its one end surrounds the injector by two arms and presses the injector against a seat or a seal (11) in the cylinder head (4) in a sealing manner via support surfaces (2), the other end of the claw (1) being supported on a support surface (5) at the cylinder head, the clamping force of the clamping claw (1) being applied with the aid of a clamping screw (7) designed as a push-through screw connection and including a screw head collar (17) and a corresponding thread in the cylinder head (4), the position of the screw being situated between the support surfaces (2) at the injector (3) and the support surfaces (5) on the cylinder head (4).

BRIEF DESCRIPTION OF THE DRAWINGS

The present disclosure is explained in greater detail below on the basis of one exemplary embodiment.

DETAILED DESCRIPTION

Figure 1:
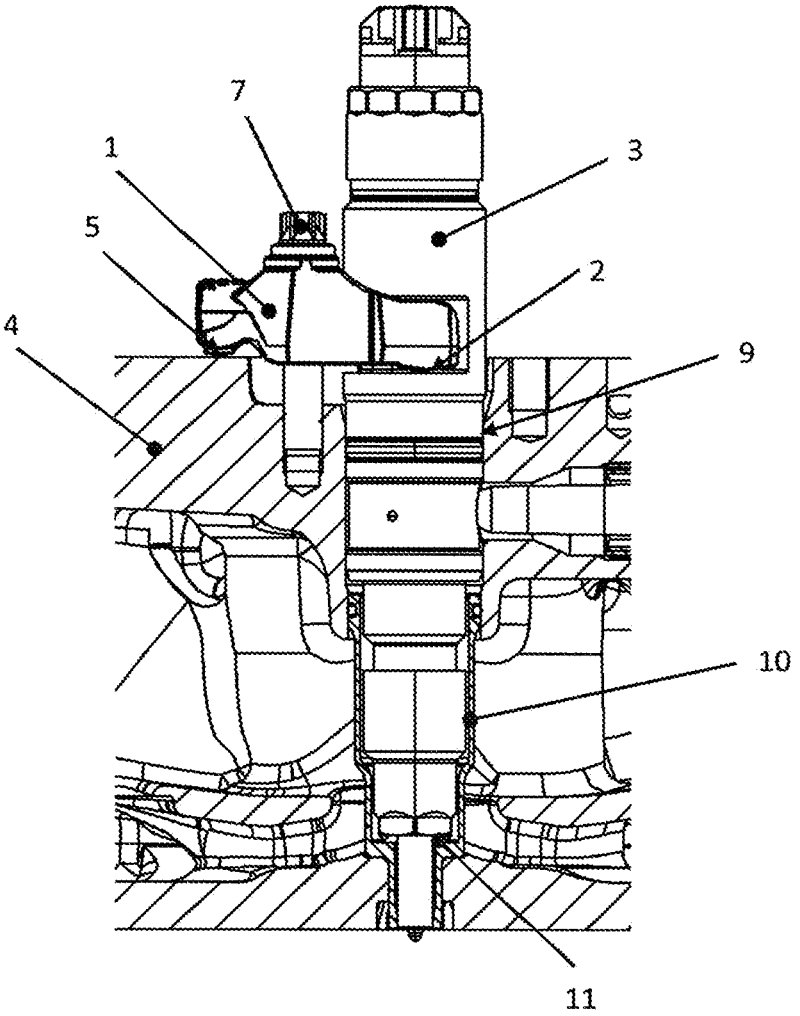
FIG. 1 shows an injector clamping mechanism according to the prior art.

An injector clamping mechanism is shown in FIG. 1, which fastens an injector 3 at a cylinder head of a diesel internal combustion engine with the aid of a claw 1. A beam-like element supports clamping claw 1 by one end on a support surface 2 of injector 3, while the second end is supported on a surface 5 at cylinder head 4. A screw 7 situated between the two ends presses claw 1 against the support surfaces, whereby the axial pressure force for sealing purposes results at the injector and fixes the injector in receiving bore 9.

In this exemplary embodiment, receiving bore 9 for injector 3 is only partially implemented by a bore in the cylinder head. No continuous vent hole through the water jacket exists here. Instead, a copper sleeve 10 is installed into a bore through the water jacket, whose interior forms the receiving bore for injector 3. Sealing ring 11 of injector 3 is also supported in this copper sleeve 10, which seals the combustion chamber against the annular fuel chamber between injector 3 and copper sleeve 10. Due to the high compression at the sealing ring support on the part of the copper sleeve, relaxation phenomena may occur, resulting in a drop in the sealing force at the injector. This results in leaks.

Figure 2:
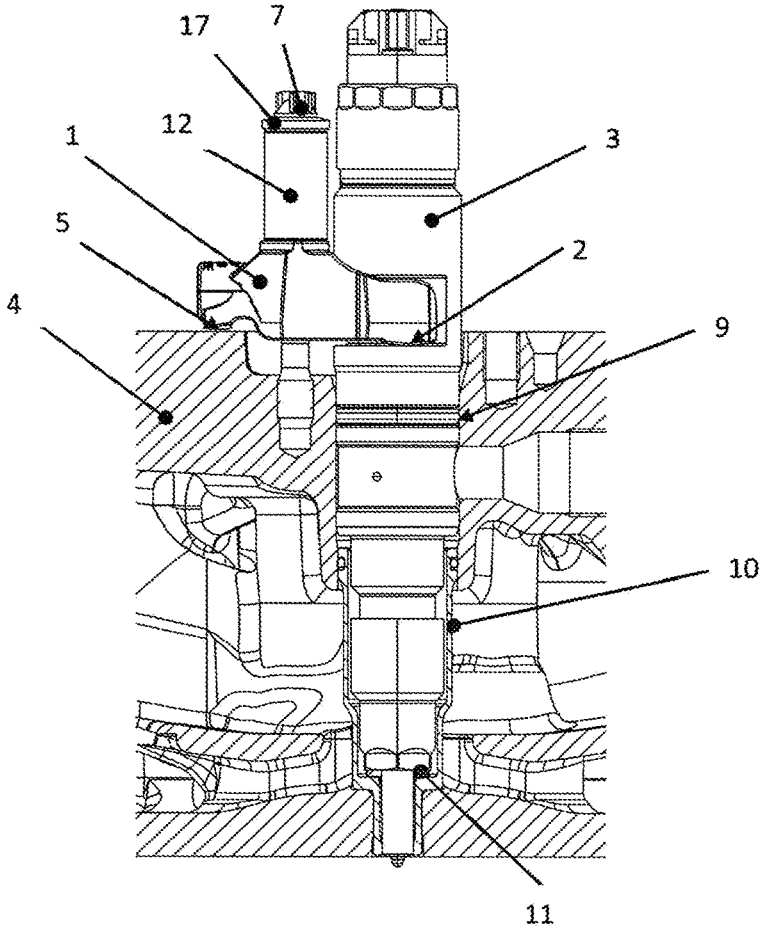
FIG. 2 shows an injector clamping mechanism.
Figure 3:
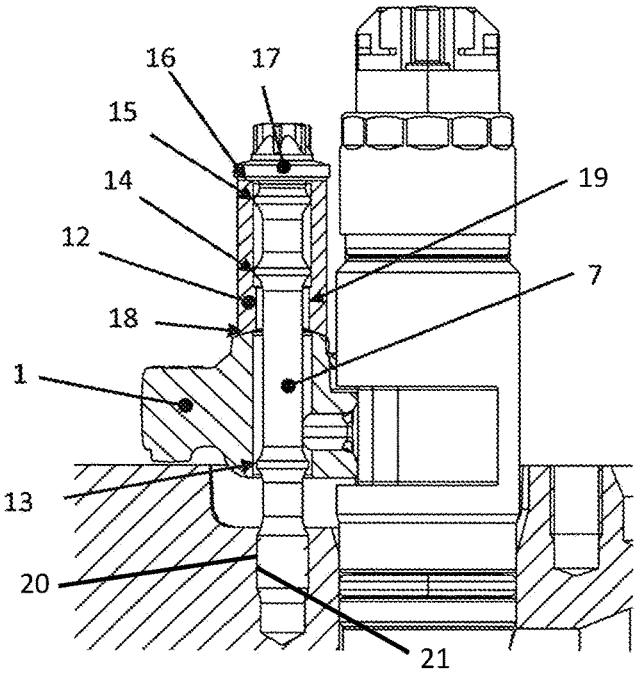
FIG. 3 shows a sectional view of the injector clamping mechanism from FIG. 2.

In the exemplary embodiment illustrated in FIGS. 2 and 3, a claw-type screw connection is apparent, which results in an increased elasticity of the bolted joint, so that the loss of sealing force as a result of the relaxation is significantly reduced. In contrast to the specific embodiment according to FIG. 1, in the injector clamping mechanism according to FIG. 2, a sleeve 12 is installed between screw head collar 17 and clamping claw 1. Screw 7 is designed as expansion screw 7 having a reduced shaft diameter. The greatly increased screw length due to sleeve 12 and the reduced shaft diameter of expansion screw 7 substantially increases the elasticity of the bolted joint. Another contribution to the elasticity increase is achieved by sleeve 12 itself. The result is a greatly increased overall elasticity in the bolted joint, for which reason the loss of pretensioning force with relaxation phenomena is significantly reduced.

FIG. 2 shows an injector clamping mechanism, which fastens an injector 3 at a cylinder head of a diesel internal combustion engine with the aid of a claw 1.

Clamping claw 1 is supported by one end on a support surface 2 at injector 3, while the second end is supported on a surface 5 at cylinder head 4. A screw 7 situated between the two ends presses claw 1 against support surfaces 2 and 5 with the aid of a sleeve 12, which is situated concentrically around clamping screw 7 between clamping screw 7 and clamping claw 1, the axial pressure force for sealing resulting at the injector and fixing injector 3 in receiving bore 9. Clamping screw 7 is designed as an expansion screw having a reduced shaft diameter. Sleeve 12 has a conical surface 18 on the underside for being supported on the spherical mating surface of clamping claw 1. On the upper side, the sleeve has a flat contact surface 16 in the direction of screw head collar 17, so that contact surface 16 is situated perpendicularly to the screw axis and rests at the screw head collar in a plane-parallel manner.

In this exemplary embodiment, receiving bore 9 for injector 3 is only partially implemented by a bore in the cylinder head. No continuous vent hole through the water jacket exists here. Instead, a copper sleeve 10 is installed into a bore through the water jacket, whose interior forms the receiving bore for injector 3. Sealing ring 11 of injector 3 is also used in this copper sleeve 10, which seals the combustion chamber against the annular fuel chamber between injector 3 and copper sleeve 10. Clamping screw 7 includes three collars 13, 14, 15 on the shaft. Lower collar 13 is used to center clamping claw 1. Middle collar 14 and upper collar 15 are used to center sleeve 12, thus achieving a stable construction of the connection. Due to the conical shape of the sleeve, sleeve 12 is unable to be installed the wrong way around with respect to claw 1 on contact surface 18, i.e., with conical support surface 18 facing the screw head. For this purpose, the bore of sleeve 12 is provided with a stepped design. Lower portion 19 of the bore has a smaller diameter than that of middle centering collar 14 of screw 7. If sleeve 12 is mounted on screw 7 the wrong way around, it may be mounted only up to middle collar 14. The position of middle collar 14 is selected in such a way that the thread 20 of screw 7 is unable to engage with the thread 21 of threaded bore at cylinder head 4 to prevent incorrect mounting.

LIST OF REFERENCE NUMERALS

1 clamping claw
2 support surface at the injector
3 injector for injecting fuel
4 cylinder head
5 support surface at the cylinder head
7 clamping screw (expansion screw)
9 receiving bore
10 copper sleeve
11 sealing ring of the injector
12 sleeve
13 lower collar
14 middle centering collar
15 upper collar
16 flat contact surface
17 screw head collar
18 contact surface (conical)
19 lower portion of the bore

What is claimed is:

1. An internal combustion engine comprising:
a working cylinder;
a cylinder head closing the working cylinder;
an injector in the cylinder head for injecting fuel for the working cylinder;
a clamping claw for fixing the injector, the clamping claw being provided in such a way that a first end of the clamping claw surrounds the injector by two arms and presses the injector against a seat or a seal in the cylinder head in a sealing manner via support surfaces, a second end of the claw being supported on a support surface at the cylinder head, a clamping force of the clamping claw being applied with the aid of a clamping screw configured as a push-through screw connection and including a shaft, a screw head collar and a corresponding thread in the cylinder head, a position of the screw being situated between the support surfaces at the injector and the support surfaces on the cylinder head; and
a clamping sleeve arranged concentrically around the clamping screw between the screw head collar and the clamping claw, the clamping screw configured for axially forcing the clamping sleeve into the clamping claw such that the clamping claw clamps the injector,
the clamping sleeve including a stepped bore defining an upper portion and a lower portion, an inner diameter of the upper portion being greater than an inner diameter of the lower portion,
the clamping screw including a first collar protruding outward from an outer diameter of the shaft,
the first collar configured for being inside the upper portion of the clamping sleeve for centering the clamping sleeve,
an outer diameter of the first collar being greater than the inner diameter of the lower portion.

2. An internal combustion engine comprising:
a working cylinder;
a cylinder head closing the working cylinder;
an injector in the cylinder head for injecting fuel for the working cylinder;
a clamping claw for fixing the injector, the clamping claw being provided in such a way that a first end of the clamping claw surrounds the injector by two arms and presses the injector against a seat or a seal in the cylinder head in a sealing manner via support surfaces, a second end of the claw being supported on a support surface at the cylinder head, a clamping force of the clamping claw being applied with the aid of a clamping screw configured as a push-through screw connection and including a shaft, a screw head collar and a corresponding thread in the cylinder head, a position of the screw being situated between the support surfaces at the injector and the support surfaces on the cylinder head;
a clamping sleeve arranged concentrically around the clamping screw between the screw head collar and the clamping claw, the clamping screw configured for axially forcing the clamping sleeve into the clamping claw such that the clamping claw clamps the injector; and
an injector sleeve installed in the cylinder head receiving the injector,
wherein the seat or seal is formed by a sealing ring supported in the injector sleeve, the clamping screw and the clamping sleeve axially forcing the clamping claw into the injector to compress the sealing ring, the clamping screw and the clamping sleeve providing an elasticity impacting a relaxation phenomena of the sealing ring.

3. The internal combustion engine as recited in claim 2, wherein the clamping screw includes three collars at the shaft including a lower collar centering the clamping claw, and a middle collar and an upper collar centering the clamping sleeve.

4. The internal combustion engine as recited in claim 3, wherein a position of the middle collar at the shaft of the clamping screw is such that a thread of the clamping screw does not engage with a thread of the cylinder head if the clamping sleeve is mounted a wrong way around.

5. The internal combustion engine as recited in claim 2, wherein the clamping sleeve has a conical surface on its side facing the clamping claw, the conical surface being supported on a spherical mating surface of the clamping claw.

6. The internal combustion engine as recited in claim 2, wherein the clamping sleeve has two different inner diameters forming a stepped bore.

7. A method for operating an internal combustion engine:

providing the internal combustion engine as recited in claim 2; and injecting fuel via the injector into the working cylinder.

8. The internal combustion engine as recited in claim 2, wherein the clamping sleeve has flat contact surface on an upper side thereof contacting a flat surface of the screw head collar.

9. The internal combustion engine as recited in claim 1, further comprising an injector sleeve installed in the cylinder head receiving the injector.

10. The internal combustion engine as recited in claim 2, wherein the injector sleeve is copper.

11. The internal combustion engine as recited in claim 2, wherein the clamping screw is an expansion screw.

12. The internal combustion engine as recited in claim 1, wherein the screw head collar is integrally fixed to an end of the shaft.

13. The internal combustion engine as recited in claim 1 wherein the clamping screw includes a second collar protruding outward from the outer diameter of the shaft, the second collar configured for being inside the clamping claw for centering the clamping claw.

14. The internal combustion engine as recited in claim 13 wherein the clamping screw includes a third collar protruding outward from the outer diameter of the shaft, the third collar configured for being inside the upper portion of the clamping sleeve for centering the clamping sleeve, an outer diameter of the third collar being greater than the inner diameter of the lower portion.

* * * * *